United States Patent [19]

Smith et al.

[11] 4,444,253

[45] Apr. 24, 1984

[54] TUBING STRING EXTENSION

[75] Inventors: David A. Smith, Enid; Marvin D. Smith, Stillwater, both of Okla.

[73] Assignee: A. Glen Smith, Del City, Okla.

[21] Appl. No.: 390,631

[22] Filed: Jun. 21, 1982

[51] Int. Cl.[3] ..... E21B 33/12

[52] U.S. Cl. ..... 166/191; 166/106; 417/172

[58] Field of Search ..... 166/191, 105.5, 105.6, 166/106, 127, 369, 372; 417/172

[56] References Cited

U.S. PATENT DOCUMENTS

| | | | |
|---|---|---|---|
| 2,290,141 | 7/1942 | Burt | 417/172 |
| 3,551,074 | 12/1970 | Stout | 417/172 |
| 4,354,554 | 10/1982 | Calhoun et al. | 166/105.5 X |

*Primary Examiner*—Ernest R. Purser
*Assistant Examiner*—Thuy M. Bui
*Attorney, Agent, or Firm*—Dunlap & Codding

[57] ABSTRACT

An apparatus adapted for use with a pump equipped tubing string disposed within a casing for use in conjunction with an oil well comprising: a tubing string extension having an upper end, a lower end and an opening extending therethrough intersecting the upper and the lower ends thereof, the upper end being connected to the depending end of the tubing string, the tubing string extension having a reduced diameter portion intermediate the upper and the lower ends thereof, at least two nozzle openings formed through the reduced diameter portion of the tubing string extension, each nozzle opening having one end intersecting the outer peripheral surface of the tubing string extension and an opposite end portion intersecting the opening extending through the reduced diameter portion of the tubing string extension, the fluid passing from the reduced diameter portion of the tubing string extension resulting in a pressure reduction causing fluid to be drawn through the nozzle openings in the tubing string extension and into and through the opening in the tubing string extension; an upper and a lower seal assembly, each seal assembly surrounding the tubing string extension, the upper and the lower seal assemblies being disposed on the tubing string extension so that the intersections of the nozzle openings with the outer peripheral surface of the tubing string extension are disposed generally within the space between the upper and the lower seal assemblies, the upper and the lower seal assemblies each being adapted to sealingly engage the tubing string extension and the casing; and vent means for venting gas existing generally below the lower seal assembly through the lower and the upper seal assemblies to substantially reduce the presence of gas in the area near the intersections of the nozzle openings with the outer peripheral surface of the tubing string extension.

9 Claims, 1 Drawing Figure

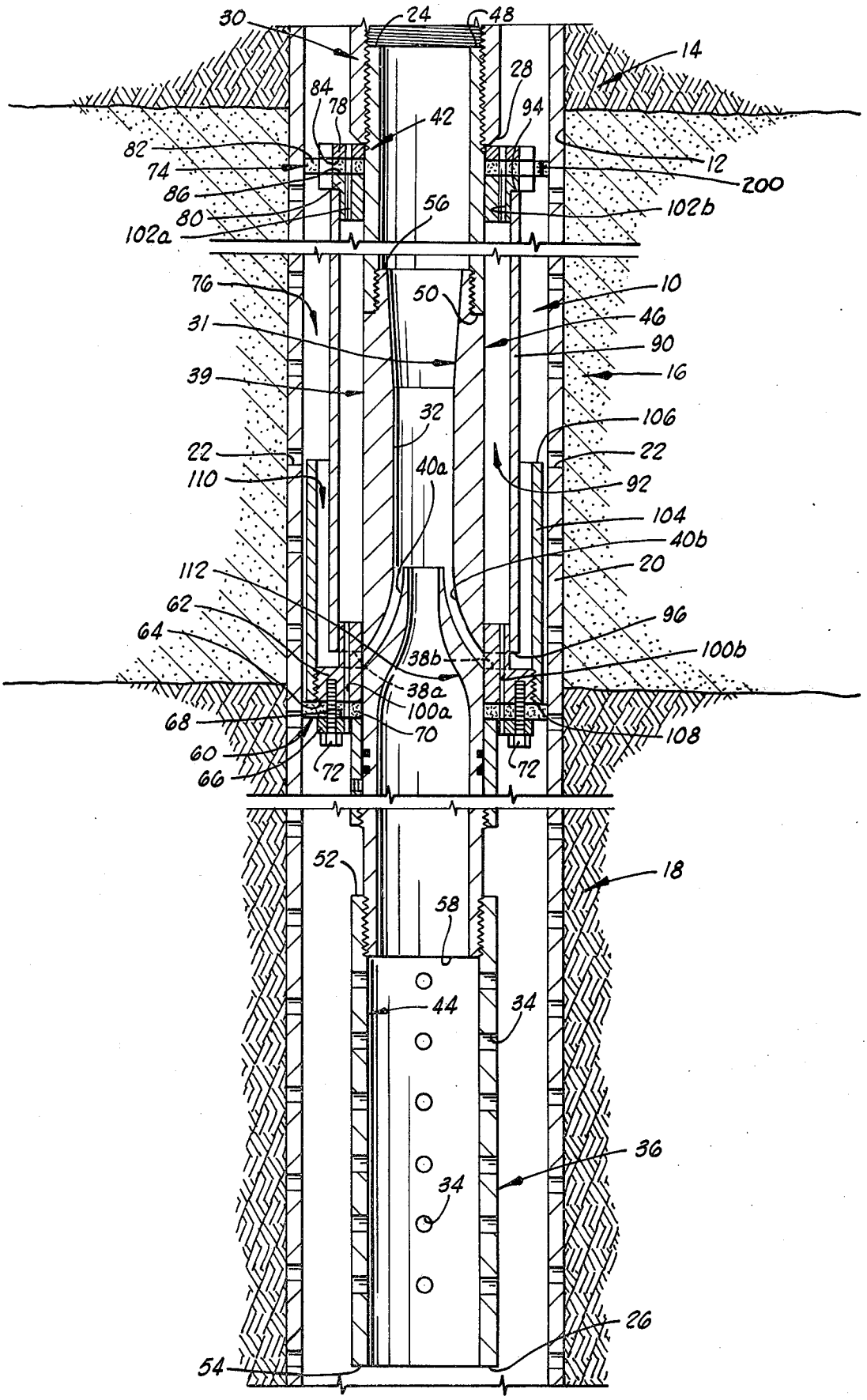
30
24
48
14
28
84
78
42
94
82
12
74
200
86
56
102b
80
102a
76
10
50
46
31
90
39
16
32
106
22
22
110
40a
92
104
40b
112
20
62
96
64
38b
100b
38a
100a
68
70
108
60
72
72
66
52
18
58
44
34
36
34
26
54

TUBING STRING EXTENSION

CROSS-REFERENCE TO RELATED APPLICATIONS

The subject matter of the present application is related to the subject matter disclosed in the co-pending application, Ser. No. 889,788, entitled Oil Well Pumping String Tubular Extension for Increasing Oil to Salt Water Ratio, now U.S. Pat. No. 4,335,786.

BRIEF DESCRIPTION OF THE DRAWINGS

The single FIGURE of the drawings is a cross sectional view of an apparatus including a tubing string extension which is constructed in accordance with the present invention.

DESCRIPTION OF THE PREFERRED EMBODIMENT

Shown in the single FIGURE in the drawings is an apparatus including an elongated tubing string extension 10 which is disposed in a borehole 12. As shown in the drawing, the borehole 12 extends through an earth soil or rock formation 14, through an oil bearing sand 16 and through a salt water and oil producing formation 18. A casing 20 is disposed in and extends generally through the borehole 12, the casing 20 generally surrounding the borehole 12. A plurality of perforations 22 are formed through the casing 20 (only two of the perforations 22 being specifically designated with a reference numeral in the drawing). The casing 22 is disposed in the borehole 12 so that the perforations 22 are disposed generally adjacent the oil bearing sand 16 and the salt water and oil producing formation 18.

The tubing string extension 10 has an upper end 24 and a lower end 26. The upper end 24 is coaxially connected to a depending end 28 of a pump equipped tubing string 30. The construction and operation of pump equipped tubing strings are well known in the art and thus a detailed description of the construction and operation of a pump equipped tubing string such as the pump equipped tubing string 30 is not deemed necessary herein.

The tubing string extension 10 has an opening 31 which extends axially therethrough intersecting the upper and the lower ends 24 and 26 thereof and includes a reduced diameter portion 12 which is disposed intermediate or generally between the upper and the lower ends 24 and 26 of the tubing string extension 10. The opening 31 is in fluidic communication with the opening extending through the tubing string 30. The tubing string extension 10 also includes a plurality of inlet ports 34 which are formed through a lower portion 36 of the tubing string extension 10 (only two of the inlet ports 34 being specifically designated with a reference numeral in the drawing).

Four nozzle openings 40 are formed through the tubing string extension 10 generally near the reduced diameter portion 32 (only two of the nozzle openings 40 being shown in the drawing and designated therein by the specific reference numerals **40*a* and 40*b*). One end of each nozzle opening 40 intersects an outer peripheral surface 39 of the tubing string extension 10 and the opposite end of each nozzle opening 40 intersects the opening 31 extending through the tubing string extension 10 generally at the reduced diameter portion 32. The nozzle openings 40 are circumferentially spaced about the tubing string extension 10 generally at about ninety degree intervals. In a preferred embodiment, each of the nozzle openings 40 is generally conically shaped with the larger opening portion of each nozzle opening 40 being disposed near the end of the nozzle opening 40 which intersects the outer peripheral surface 39 of the tubing string extension 10 and the smaller opening end portion of each of the nozzle openings 40 being generally near the end of each nozzle opening 40 which intersects the opening 31 extending through the tubing string extension 10**.

The tubing string extension 10, more particularly, includes an upper tubular member 42, a lower tubular member 44 and an intermediate tubular member 46. The upper tubular member 42 has an upper end 48 and a lower end 50 with the upper end 48 being threadedly connected to the depending end 28 of the pump equipped tubing string 30 and forming the upper end 24 of the tubing string extension 10. The lower tubular member 44 has an upper end 52 and a lower end 54 with the lower end 54 forming the lower end 26 of the tubing string extension 10. The intermediate tubular member 46 has an upper end 56 and a lower end 58 with the upper end 56 being threadedly connected to the lower end 50 of the upper tubular member 42 and the opposite lower end 58 being threadedly connected to the upper end 54 of the lower tubular member 44. The reduced diameter portion 32, more particularly, is formed in the intermediate tubular member 46 and the inlet ports 34, more particularly, are formed through the lower tubular member 44.

The upper tubular member 42 has an opening which extends axially therethrough and intersects the upper and the lower ends 48 and 50 thereof. The lower tubular member 44 has an opening which extends axially therethrough and intersects the upper and the lower ends 52 and 54 thereof. The intermediate tubular member 46 has an opening which extends axially therethrough and intersects the upper and the lower ends 56 and 58 thereof. The openings extending through the upper, the lower and the intermediate tubular members 42, 44 and 46 are in fluidic communication and cooperate to form the opening 31 which extends through the tubing string extension 10.

A lower seal assembly 60 is connected to and generally surrounds the tubing string extension 10, the lower seal assembly 60 being disposed generally below the reduced diameter portion 32 of the tubing string extension 10. More particularly, the lower seal member 60 is disposed below the intersection of the nozzle openings 40 with the outer peripheral surface 39 of the tubing string extension 10. The lower seal assembly 60 is adapted to sealingly engage the inside surface of the casing 20 and to sealingly engage the outer peripheral surface 39 of the tubing string extension 10. The lower seal assembly 60 forms a seal generally between the tubing string extension 10 and the casing 20.

The lower seal assembly 60, more particularly, includes a retainer 62 which is connected to and extends a distance generally radially from the intermediate tubular member 46, the retainer 62 having a lower face 64 which extends a distance from the outer peripheral surface of the intermediate tubular member 46. Four openings 38 are formed through the retainer 62 and each of the openings 38 is aligned with the opening formed by the intersection of one of the nozzle openings 40 with the outer peripheral surface 39 of the tubing string extension 10, each opening 38 being in fluidic communication with one of the nozzle openings 40 (only two of the openings 38 being shown in the drawing and designated therein by the specific reference numerals 38*a* and 38*b*).

The lower seal assembly 60 also includes a bolt plate 66 which extends generally about the outer peripheral surface of the intermediate tubular member 46 and has an upper face 68 which extends a distance generally radially from the outer peripheral surface of the intermediate member 46. A seal member 70 is disposed between the lower face 64 of the retainer 62 and the upper face 68 of the bolt plate 66. A plurality of bolts 72 extend through the retainer 62, the seal member 70 and the bolt plate 66, the bolt 72 threadedly securing the bolt plate 66 to the retainer 62 with the seal member 70 being disposed between the retainer 62 and the bolt plate 66. One portion of the seal member 70 sealingly engages the outer peripheral surface of the intermediate tubular member 46 and another portion of the seal member 70 sealingly engages the inner peripheral surface of the casing 20.

An upper seal assembly 74 surrounds the tubing string extension 10 and is disposed generally above the reduced diameter portion 32, the upper seal assembly 74 being adapted for sealing with the inside surface of the casing 20 and forming a seal generally between the tubing string extension 10 and the casing 20. The lower and the upper seal assemblies 60 and 74 cooperate with the casing 20 to sealingly isolate a space 76 generally between the intermediate tubular member 46 and the casing 20 with the nozzle openings 40 and the reduced diameter portion 32 being disposed generally within the space 76. More particularly, the intersections of the nozzle openings 40 with the outer peripheral surface 39 of the tubing string extension 10 (the suction side or end of the nozzle openings 40) are disposed within the space 76 between the upper and the lower seal assemblies 60 and 74.

The upper seal assembly 74, more particularly, includes an upper mounting plate 78, a lower mounting plate 80 and a seal member 82. The upper mounting plate 78 extends about the outer peripheral surface of the upper tubular member 42 and includes a lower surface 84 which extends a distance generally radially from the outer peripheral surface of the upper tubular member 42. The lower mounting plate 80 extends generally about a portion of the upper tubular member 42 and includes an upper surface 86 which extends a distance generally radially from the outer peripheral surface of the upper tubular member 42. The upper surface 86 of the lower mounting plate 80 is spaced a distance from the lower surface 84 of the upper mounting plate 78 and the seal member 82 is disposed generally between the upper and the lower mounting plate 78 and 80. The seal member 82 is disposed between and held in place by the upper and the lower mounting plates 78 and 80. The seal member 82 sealingly engages the outer peripheral surface of the upper tubular member 42 and another portion of the seal member 82 sealingly engages the inner peripheral surface of the casing 20.

A cylindrically shaped cylinder 90 is connected to the tubing string extension 10, the cylinder 90 extending about a portion of the outer peripheral surface 39 of the tubing string extension 10 and being spaced a distance from the outer peripheral surface 39 of the tubing string extension 10 to form a space 92 generally between the inner peripheral surface of the cylinder 90 and the outer peripheral surface 39 of the tubing string extension 10. The cylinder 90, more particularly, has an upper end 94 and a lower end 96. The upper end 94 portion of the cylinder 90 is sealingly connected to the lower mounting plate 80 of the upper seal assembly 74 and the lower end 96 portion of the cylinder 90 is sealingly connected to the retainer 62 of the lower seal assembly 60, the cylinder 90 being sealingly connected to the upper and lower seal assemblies 74 and 60, respectively, and extending generally between the upper and the lower seal assemblies 74 and 60, respectively. The outer peripheral surface of the cylinder 92 is spaced a distance from the inner peripheral surface of the casing 22.

A plurality of vent openings 100 are formed through the lower seal assembly 60, each of the vent openings 100 extending through the retainer 62, through the seal member 70 and through the bolt plates 66 of the lower seal assembly 60 (only two vent openings 100 being shown in the drawing and designated therein by the specific reference numerals 100*a* and 100*b*). The vent openings 100 are circumferentially spaced about the lower seal assembly 60.

A plurality of vent openings 102 are formed through the upper seal assembly 74, each vent opening 102 extending through the upper mounting plate 78, through the lower mounting plate 80 and through the seal member 82 (only two of the vent openings 102 being shown in the drawing and designated therein by the specific reference numerals 102*a* and 102*b*). The vent openings 102 are spaced circumferentially about the upper seal assembly 74. A baffle 104 is connected to the tubing string extension 10 generally below the intersection of the nozzle openings 40 with the outer peripheral surface 39 of the tubing string extension 10. More particularly, the baffle 104 has an upper end 106 and a lower end 108 and the lower end 108 portion of the baffle 104 is threadedly connected to the outer peripheral surface of the retainer 62 of the lower seal member 60. The baffle 104 has an inner peripheral surface which is spaced a distance from the outer peripheral surface of the tubing string extension 10 and the inner peripheral surface of the baffle 104 also is spaced a distance from the outer peripheral surface of the cylinder 90 forming a space 110 generally between the baffle 104 and the cylinder 90. The space 110 is in fluidic communication with the nozzle openings 40 via the openings 38. In one preferred embodiment, the baffle 104 extends from the lower end portion of the reduced diameter portion 32 of the tubing string extension 10 generally upwardly a distance of about one-half the length of the reduced diameter portion 32.

During the operation, a pump (not shown) draws salt water and oil from the salt water and oil producing formation and the stream of fluid is pumped into the opening in the lower tubular member 44 through the inlet ports 34, the fluid passing upwardly through the openings formed in the lower, the intermediate and the upper tubular members 44, 46 and 42 and, then, generally upwardly through the tubing string 30. When the fluid passes through the reduced diameter portion 32, a pressure drop occurs causing fluid to be drawn through the nozzle openings 40, the fluid being drawn through the nozzle openings 40 passing into the opening formed in the intermediate tubular member 46 and mixing with the fluid flow being passed upwardly through the intermediate tubular member 46 and the upper tubular member 42.

Oil in the formation passes through the openings 22 in the casing 20. Some of this oil passes into the space generally between the upper and the lower seal assemblies 74 and 60, respectively. The oil passing into the space 76 passes downwardly through the space 110 between the baffle 104 and the outer peripheral surface of the cylinder 90. This oil passes through the space 110 and through the openings 38 in the retainer 62. The oil passes from the openings 38 into and through the nozzle openings 40, such oil being passed from the nozzle openings 40 into the opening formed in the intermediate tubular member 46 and the oil passing from the nozzle openings 40 mixes with the oil being passed upwardly through the openings in the lower tubular member 44 and the intermediate tubular member 46.

Gas which may exist in the space between the tubing string extension 10 and the casing 20 generally below the lower seal assembly 60 is sealed from the space 76 generally between the lower and the upper seal assemblies 60 and 74, respectively, and such gas is vented through the vent openings 100 upwardly through the space between the cylinder 90 and the tubular extension member 10 and then vented through the vent openings 102. Thus, the lower and the upper seal assemblies 60 and 74 cooperate to seal the space 76 to substantially prevent gas from entering the space 76, and the cylinder 90 cooperates with the vent openings 100 and 102 formed through the lower and the upper seal assemblies 60 and 74, respectively, to substantially prevent gas from entering the space generally near the entrance or inlet ends of the nozzle openings 40. The lower and the upper seal assemblies 60 and 74 thus cooperate to isolate the space on the suction or inlet ends of the nozzle openings to substantially reduce the presence of gas on the suction or inlet ends of the nozzle openings 40, because, if gas is produced generally near the suction or inlet ends of the nozzle openings 40, such gas will expand when it hits the throat of the nozzle openings 40 thereby increasing in volume. Thus, gas presence in the nozzle openings 40 acts to decrease the amount of area left for fluid to enter and thus has the effect of decreasing the flow of oil through the nozzle openings 40. In the event gas does get into the area 76 between the upper and the lower seal assemblies 74 and 60, such gas and fluid must pass downwardly through the space 110 between the baffle 104 and the cylinder 90 before entering the nozzle openings 40, which permits some of such gas to bubble upwardly and out of the fluid before such fluid enters the nozzle openings 40, this gas being vented through a vent opening 200 formed through the seal member 82 to the space generally above the upper seal assembly 74.

The vent openings 100 and 102 cooperate to vent the gas and allows fluid communication between the lower and the upper seal assemblies 60 and 74 thereby equalizing the pressure below the lower seal assembly 60 and above the upper seal assembly 74 and to allow a fluid level to be attained above the pump level.

Changes may be made in the construction and operation of the various elements and components described herein without departing from the spirit and scope of the invention as defined in the following claims.

What is claimed is:

1. An apparatus adapted for use with a pump equipped tubing string within a casing for use in conjunction with an oil well comprising:

a tubing string extension having an upper end, a lower end, an outer peripheral surface and an opening extending therethrough intersecting the upper and the lower ends thereof, the upper end of the tubing string extension being co-axially connected to the depending end of the tubing string, the tubing string extension a reduced diameter portion intermediate the upper and the lower ends thereof, and at least two nozzle openings being formed through a portion of the tubing string extension with each nozzle opening having one end intersecting the opening in the tubing string extension in the reduced diameter portion of the tubing string extension and the opposite end of the nozzle opening intersecting the outer peripheral surface of the tubing string extension;

a lower seal assembly surrounding the tubing extension and disposed generally below the intersections of the nozzle openings and the outer peripheral surface of the tubing string extension, the lower seal assembly being adapted for sealingly engaging the tubing string extension and sealingly engaging the inside surface of the casing, thereby forming a seal therebetween;

an upper seal assembly surrounding the tubing string extension and disposed generally above the intersections of the nozzle openings and the outer peripheral surface tube, the tubing string extension, the upper seal assembly being adapted for sealingly engaging the tubing string extension and sealingly engaging the inside surface of the casing, thereby forming a seal therebetween, the upper seal assembly and the lower seal assembly cooperating with the casing to substantially sealingly isolate the space between the upper and the lower seal assemblies and between the tubing string extension and the casing; and vent means between the upper and the lower seal assemblies for venting gas existing generally below the lower seal assembly in the space between the tubing extension and the casing through the lower and the upper seal assemblies substantially to reduce such gas presence in the area near the intersections of the nozzle openings with the outer peripheral surface of the tubing string extension, the fluid passing through the reduced diameter portion of the tubing string extension resulting in a pressure reduction near the nozzle openings thereby causing fluid to be drawn through the nozzle openings in the tubing string extension into the opening in the tubing string extension.

2. The apparatus of claim 1 wherein the casing is defined further as including openings extending therethrough to permit the flow of fluid from the surrounding formation through and into the casing.

3. An apparatus adapted for use with a pump equipped tubing string within a casing for use in conjunction with an oil well comprising:

a tubing string extension having an upper end, a lower end, an outer peripheral surface and an opening extending therethrough intersecting the upper and the lower ends thereof, the upper end of the tubing string extension being co-axially connected to the depending end of the tubing string, the tubing string extension a reduced diameter portion intermediate the upper and the lower ends thereof, and at least two nozzle openings being formed through a portion of the tubing string extension with each nozzle opening having one end intersecting the opening in the tubing string extension in the reduced diameter portion of the tubing string extension and the opposite end of the nozzle opening intersecting the outer peripheral surface of the tubing string extension;

a lower seal assembly surrounding the tubing extension and disposed generally below the intersections of the nozzle openings and the outer peripheral surface of the tubing string extension, the lower seal assembly being adapted for sealingly engaging the tubing string extension and sealingly engaging the inside surface of the casing, thereby forming a seal therebetween;

an upper seal assembly surrounding the tubing string extension and disposed generally above the intersections of the nozzle openings and the outer peripheral surface tube, the tubing string extension, the upper seal assembly being adapted for sealingly engaging the tubing string extension and sealingly engaging the inside surface of the casing, thereby forming a seal therebetween, the upper seal assembly and the lower seal assembly cooperating with the casing to substantially sealingly isolate the space between the upper and the lower seal assemblies and between the tubing string extension and the casing; and vent means between the upper and the lower seal assemblies for venting gas existing generally below the lower seal assembly through the lower and the upper seal assemblies substantially to reduce such gas presence in the area near the intersections of the nozzle openings with the outer peripheral surface of the tubing string extension, the fluid passing through the reduced diameter portion of the tubing string extension resulting in a pressure reduction near the nozzle openings thereby causing fluid to be drawn through the nozzle openings in the tubing string extension into the opening in the tubing string extension, comprising:

a cylinder having an upper end and a lower end, the upper end portion of the cylinder being connected to the upper seal assembly and the lower end portion of the cylinder being connected to the lower seal assembly, the cylinder extending circumferentially about a portion of the tubing string extension and the cylinder extending generally between the upper and the lower seal assemblies, the cylinder being spaced a distance from the outer peripheral surface of the tubing string extension, the lower seal assembly having at least two vent openings extending through the lower seal assembly, the vent openings in the lower seal assembly being in fluidic communication with the space between the cylinder and the outer peripheral surface of the tubing string extension, and the upper seal assembly having at least two vent openings, each of the vent openings being in fluidic communication with the space between the cylinder and the outer peripheral surface of the tubing string extension, the vent openings in the upper seal assembly and the vent openings in the lower seal assembly cooperating with the space between the cylinder and the tubing string extension to provide a passageway for venting gas from the space generally below the lower seal assembly into the space generally above the upper seal assembly.

4. The apparatus of claim 3 defined further to include:

a generally cylindrically shaped baffle having an upper end and a lower end, the lower end portion of the baffle being connected to the lower seal assembly and the baffle extending a distance from the lower seal assembly generally toward the upper seal assembly, the baffle being spaced a distance from the outer peripheral surface of the cylinder to provide a passageway extending generally between the cylinder and the baffle, the passageway between the cylinder and the baffle being in fluidic communication with the intersections of the nozzle openings with the outer peripheral surface of the tubing string extension.

5. An apparatus adapted for use with a pump equipped tubing string within a casing for use in conjunction with an oil well comprising:

a tubing string extension having an upper end, a lower end, an outer peripheral surface and an opening extending therethrough intersecting the upper and the lower ends thereof, the upper end of the tubing string extension being co-axially connected to the depending end of the tubing string, the tubing string extension a reduced diameter portion intermediate the upper and the lower ends thereof, and at least two nozzle openings being formed through a portion of the tubing string extension with each nozzle opening having one end intersecting the opening in the tubing string extension in the reduced diameter portion of the tubing string extension and the opposite end of the nozzle opening intersecting the outer peripheral surface of the tubing string extension, the tubing string extension comprising:

a lower tubular member having an upper end, a lower end and an opening extending therethrough intersecting the upper and the lower ends thereof, the inlet ports being formed through the lower tubular member and the lower end of the lower tubular member forming the lower end of the tubing string extension;

an intermediate tubular member having an upper end, a lower end and an opening extending therethrough intersecting the upper and the lower ends thereof, the lower end portion of the intermediate tubular member being connected to the upper end portion of the lower tubular member and the reduced diameter portion of the tubing string extension being formed in the intermediate tubular member generally between the upper and the lower ends of the intermediate tubular member; and an upper tubular member having an upper end, a lower end and an opening extending therethrough intersecting the upper and the lower ends thereof, the lower end of the upper tubular member being connected to the upper end of the intermediate tubular member and the upper end of the upper tubular member being connected to the depending end of the pump equipped tubing string, the openings in the upper tubular member, the lower tubular member and the intermediate tubular member providing the opening extending through the tubing string extension;

a lower seal assembly surrounding the tubing extension and disposed generally below the intersections of the nozzle openings and the outer peripheral surface of the tubing string extension, the lower seal assembly being adapted for sealingly engaging the tubing string extension and sealingly engaging the inside surface of the casing, thereby forming a seal therebetween;

an upper seal assembly surrounding the tubing string extension and disposed generally above the intersections of the nozzle openings and the outer peripheral surface tube, the tubing string extension, the upper seal assembly being adapted for sealingly engaging the tubing string extension and sealingly engaging the inside surface of the casing, thereby forming a seal therebetween, the upper seal assembly and the lower seal assembly cooperating with the casing to substantially sealingly isolate the space between the upper and the lower seal assemblies and between the tubing string extension and the casing; and vent means between the upper and the lower seal assemblies for venting gas existing generally below the lower seal assembly through the lower and the upper seal assemblies substantially to reduce such gas presence in the area near the intersections of the nozzle openings with the outer peripheral surface of the tubing string extension, the fluid passing through the reduced diameter portion of the tubing string extension resulting in a pressure reduction near the nozzle openings thereby causing fluid to be drawn through the nozzle openings in the tubing string extension into the opening in the tubing string extension.

6. An apparatus adapted for use with a pump equipped tubing string within a casing for use in conjunction with an oil well comprising:

a tubing string extension having an upper end, a lower end, an outer peripheral surface and an opening extending therethrough intersecting the upper and the lower ends thereof, the upper end of the tubing string extension being co-axially connected to the depending end of the tubing string, the tubing string extension a reduced diameter portion intermediate the upper and the lower ends thereof, and at least two nozzle openings being formed through a portion of the tubing string extension with each nozzle opening having one end intersecting the opening in the tubing string extension in the reduced diameter portion of the tubing string extension and the opposite end of the nozzle opening intersecting the outer peripheral surface of the tubing string extension;

a lower seal assembly surrounding the tubing extension and disposed generally below the intersections of the nozzle openings and the outer peripheral surface of the tubing string extension, the lower seal assembly being adapted for sealingly engaging the tubing string extension and sealingly engaging the inside surface of the casing, thereby forming a seal therebetween;

an upper seal assembly surrounding the tubing string extension and disposed generally above the intersections of the nozzle openings and the outer peripheral surface tube, the tubing string extension, the upper seal assembly being adapted for sealingly engaging the tubing string extension and sealingly engaging the inside surface of the casing, thereby forming a seal therebetween, the upper seal assembly and the lower seal assembly cooperating with the casing to substantially sealingly isolate the space between the upper and the lower seal assemblies and between the tubing string extension and the casing, the upper seal assembly defined further to include:

an upper mounting plate having a lower surface, the upper mounting plate being connected to the tubing string extension generally near the upper end of the tubing string extension and the lower surface of the upper mounting plate extending a distance radially from the outer peripheral surface of the tubing string extension;

a lower mounting plate having an upper surface, the lower mounting plate being connected to the tubing string extension generally near the upper end of the tubing string extension and the upper surface of the lower mounting plate extending a distance generally radially from the outer peripheral surface of the tubing string extension, the upper surface of the lower mounting plate being spaced a distance from the lower surface of the upper mounting plate; and a seal member disposed generally between the upper and the lower mounting plates, a portion of the seal member sealingly engaging the outer peripheral surface of the tubing string extension and another portion of the seal member sealingly engaging the casing, the upper and the lower mounting plates cooperating to secure the seal member in position;

an upper seal assembly surrounding the tubing string extension and disposed generally above the intersections of the nozzle openings and the outer peripheral surface tube, the tubing string extension, the upper seal assembly being adapted for sealingly engaging the tubing string extension and sealingly engaging the inside surface of the casing, thereby forming a seal therebetween, the upper seal assembly and the lower seal assembly cooperating with the casing to substantially sealingly isolate the space between the upper and the lower seal assemblies and between the tubing string extension and the casing; and vent means between the upper and the lower seal assemblies for venting gas existing generally below the lower seal assembly through the lower and the upper seal assemblies substantially to reduce such gas presence in the area near the intersections of the nozzle openings with the outer peripheral surface of the tubing string extension, the fluid passing through the reduced diameter portion of the tubing string extension resulting in a pressure reduction near the nozzle openings thereby causing fluid to be drawn through the nozzle openings in the tubing string extension into the opening in the tubing string extension.

7. The apparatus of claim 6 wherein the vent means is defined further to include at least two vent openings, each of the vent openings extending through the upper mounting plate, the seal member and the lower mounting plate.

8. The apparatus of claim 7 wherein the lower seal assembly is defined further to include:

a retainer having a lower face, the retainer being connected to the tubing string extension and the lower face extending a distance generally radially from the outer peripheral surface of the tubing string extension;

a bolt plate having an upper surface, the bolt plate being connected to the tubing string extension and the upper surface extending a distance generally radially from the outer peripheral surface of the tubing string extension, the upper surface of the bolt plate being spaced a distance from the lower surface of the retainer;

a seal member disposed generally between the retainer and the bolt plate, a portion of the seal member sealingly engaging the tubing string extension and another portion of the seal member sealingly engaging the casing; and means securing the retainer to the bolt plate, the seal member being secured in position generally between the retainer and the bolt plate.

9. The apparatus of claim 8 wherein the vent means is defined further to include at least two vent openings, each vent opening extending through the retainer, the bolt plate and the seal member of the lower seal assembly.

* * * * *